US006932658B2

(12) United States Patent
Liang

(10) Patent No.: US 6,932,658 B2
(45) Date of Patent: Aug. 23, 2005

(54) FUSE HOLDER

(76) Inventor: Wen Liang, No. 10 Lane 138, Wente 2nd Rd., Loshan Tsun, Kueishan Hsiang, Taoyuan County (TW)

( * ) Notice: Subject to any disclaimer, the term of this patent is extended or adjusted under 35 U.S.C. 154(b) by 0 days.

(21) Appl. No.: 10/747,361

(22) Filed: Dec. 30, 2003

(65) Prior Publication Data

US 2005/0142956 A1 Jun. 30, 2005

(51) Int. Cl.[7] ..... H01R 4/48
(52) U.S. Cl. ..... 439/816; 439/250
(58) Field of Search ..... 439/246, 250, 439/366, 621, 622, 830–833; 337/186, 194, 337/195

(56) References Cited

U.S. PATENT DOCUMENTS 2,943,295 A * 9/1960 Stewart ..... 439/831
3,082,399 A * 3/1963 Brandhorst ..... 439/833
3,885,058 A * 5/1975 Duy et al. ..... 427/10
4,037,917 A * 7/1977 Clement ..... 439/831
4,278,316 A * 7/1981 White ..... 439/831
4,547,036 A * 10/1985 Keglewitsch et al. ..... 439/680
5,618,209 A * 4/1997 Lin et al. ..... 439/621

* cited by examiner

*Primary Examiner*—Ross Gushi
*Assistant Examiner*—James R. Harvey
(74) *Attorney, Agent, or Firm*—Rosenberg, Klein & Lee

(57) ABSTRACT

A fuse holder includes a base, metal conducting blocks mounted on the base at the top for power input/output, each metal conducting block having one or a number of insertion slots and a recessed receiving hole in each insertion slot at one lateral side, arched metal spring plates respectively mounted in the recessed receiving holes in the insertion slots of the metal conducting blocks and adapted to hold down the conducting blades of fuses in the insertion slots of the metal conducting blocks, and a top cover fastened to the base and covered over the metal conducting blocks.

3 Claims, 5 Drawing Sheets

FUSE HOLDER

BACKGROUND OF THE INVENTION

1. Field of the Invention

The present invention relates to fuse holders and, more particularly to such a fuse holder, which is inexpensive to manufacture and, produces low impedance during transmission of electricity.

2. Description of the Related Art

FIGS. 6 and 7 show a fuse holder constructed according to the prior art. According to this design, the fuse holder comprises a base 4, a plurality of metal conducting blocks 5 arranged at the top side of the base 4, a plurality of metal conductive clamps 51 respectively fastened to the metal conducting blocks 5 for securing fuses, and a cover (not shown) covered on the base 4 over the metal conducting blocks 5. Each metal conductive clamp 51 comprises a mounting portion 512 fastened to the bottom side of one metal conducting block 5 and one metal conducting spring plate 7 by screws 52, and a clamping portion 511 bilaterally upwardly extended from one end of the mounting portion 512 and adapted to hold one conducting blade of a fuse. This design of fuse holder has drawbacks as follows:

1. Because each metal conductive clamp 51 is fastened to the mounting portion 512 of the corresponding metal conductive clamp 51 with a respective screw 52, the connection between the metal conductive clamp 51 and the corresponding metal conducting block 5 is not tight, resulting in high impedance and low conducting efficiency between the metal conducting block 5 and the corresponding metal conductive clamp 51.

2. The use of a secondary screw 52 to fasten the mounting portion 512 of each metal conductive clamp 51 to the corresponding metal conductive clamp 51 complicates the installation procedure, increasing the installation cost.

FIGS. 8–10 show another design of fuse holder according to the prior art. According to this design, each metal conducting block 6 has at least one insertion slot 61 adapted to receive one metal conducting spring plate 7, and a bottom notch 62 at the bottom side of each insertion slot 61. After installation of one metal conducting spring plate 7 in one insertion slot 61 of one metal conducting block 6, the bottom bent 71 of the metal conducting spring plate 7 extends to the bottom notch 62. After the cover 8 covered on the base 81 of the fuse holder, the bottom bent 71 is maintained in between the corresponding metal conducting block 6 and the base 81. When in use, the conducting blades 31 of fuses 3 are respectively inserted into the insertion slots 61 of the metal conducting blocks 6 and maintained in close contact with the metal conducting spring plates 7 in the insertion slots 61 of the metal conducting blocks 6. This design of fuse holder is still not satisfactory in function due to the following drawbacks:

1. Due to dimension tolerance, the bottom bent 71 may not fit the bottom notch 62 of the corresponding metal conducting block 6 perfectly, and the metal conducting spring plate 7 may not be positively secured to the inside of the corresponding insertion slot 61, thereby producing a barrier to the insertion of the conducting blade 31 of the fuse 3.

2. Because each metal conducting spring plate 7 has one end fixed and the other end movable for holding down the conducting blade 31 of one fuse, it may be deformed easily or may start to wear quickly with use.

SUMMARY OF THE INVENTION

The present invention has been accomplished under the circumstances in view. It is one object of the present invention to provide a fuse holder, which positively secures the conducting blades of the inserted fuses in contact with the metal conducting blocks. It is another object of the present invention to provide a fuse holder, which is inexpensive to manufacture, and easy to install. It is still another object of the present invention to provide a fuse holder, which produces low impedance during transmission of electricity. To achieve these and other objects of the present invention, the fuse holder comprises a base, metal conducting blocks mounted on the base at the top for power input/output, each metal conducting block having one or a number of insertion slots and a recessed receiving hole in each insertion slot at one lateral side, arched metal spring plates respectively mounted in the recessed receiving holes in the insertion slots of the metal conducting blocks and adapted to hold down the conducting blades of fuses in the insertion slots of the metal conducting blocks, and a top cover fastened to the base and covered over the metal conducting blocks. Further, each recessed receiving hole of each metal conducting block has two vertically spaces stop edges; each arched metal spring plate has two positioning flanges respectively extended from two distal ends and respectively stopped at the stop edges of the corresponding recessed receiving hole.

DETAILED DESCRIPTION OF THE PREFERRED EMBODIMENT

Figure 1:
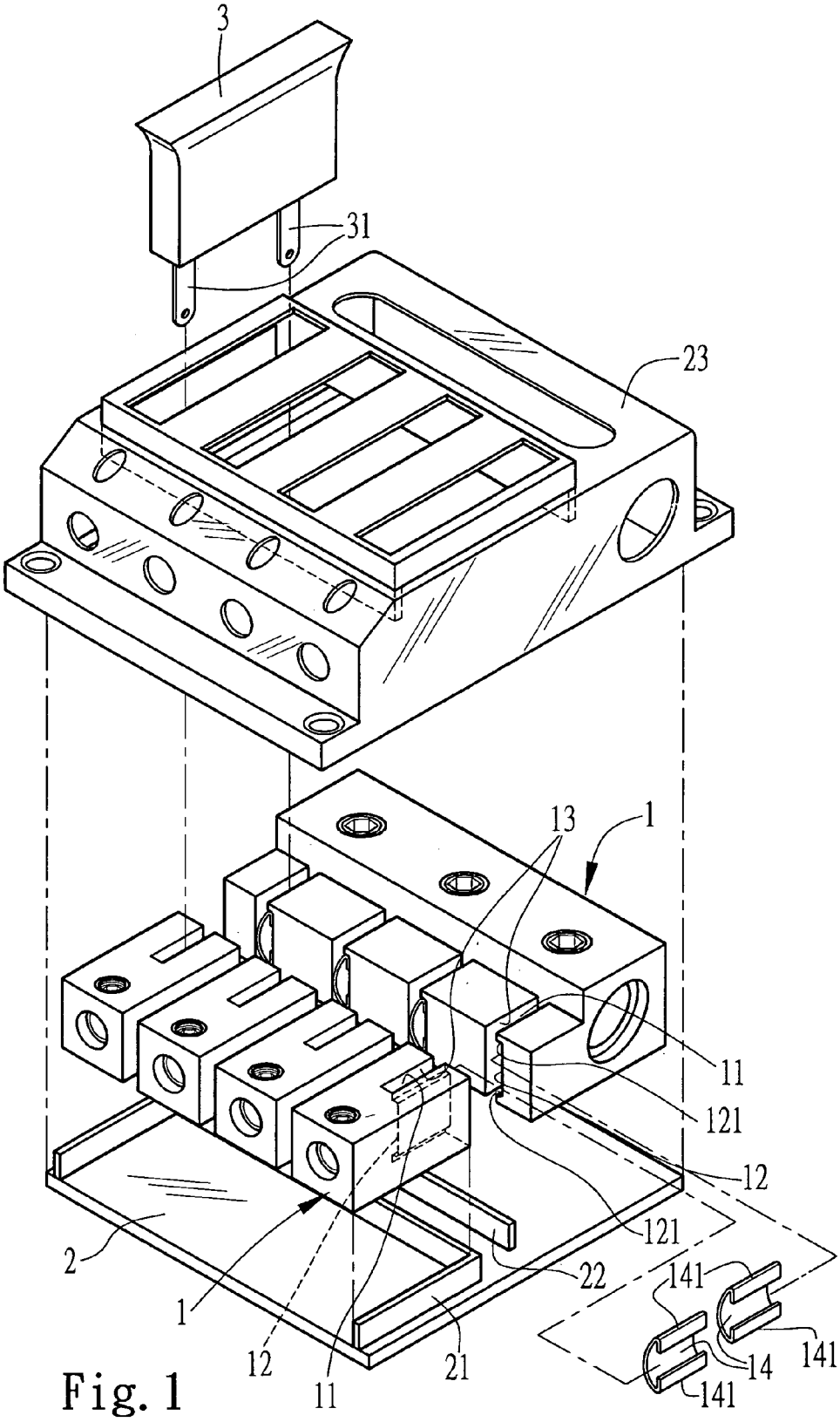
FIG. 1 is an exploded view of a fuse holder according to the present invention.
Figure 2:
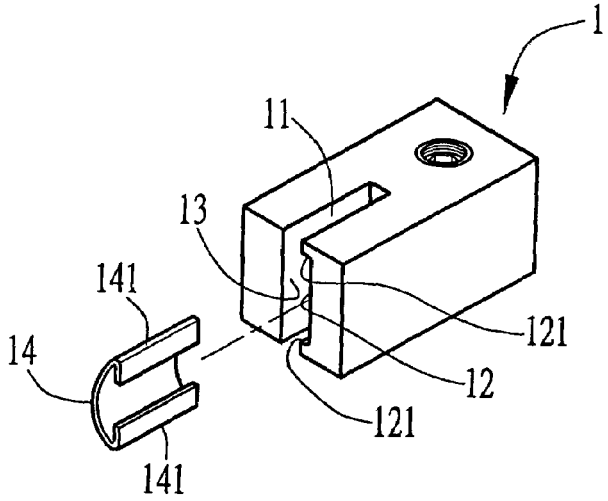
FIG. 2 is an exploded view of a part of the present invention, showing the relationship between one metal conducting block and one arched metal spring plate.
Figure 3:
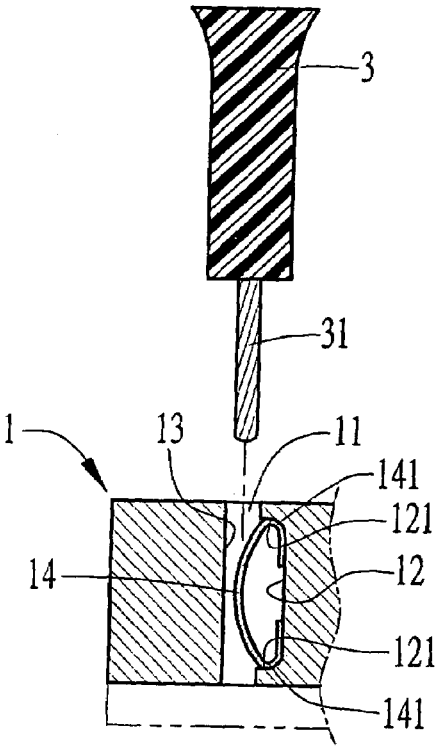
FIG. 3 is a schematic drawing of a part of the present invention showing the positioning status of the arched metal spring plate in the respective insertion slot before insertion of the conducting blade of the fuse.
Figure 4:
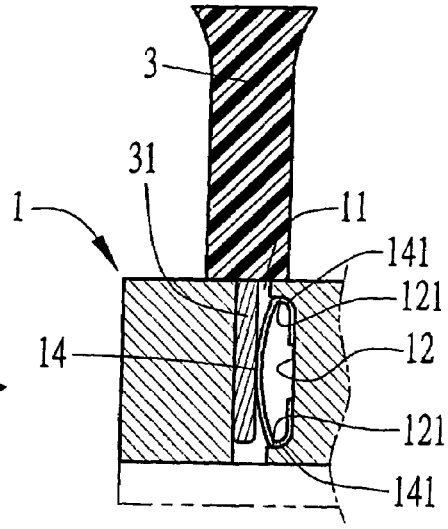
FIG. 4 is similar to FIG. 3 but showing the conducting blade of the fuse inserted into the insertion slot.
Figure 5:
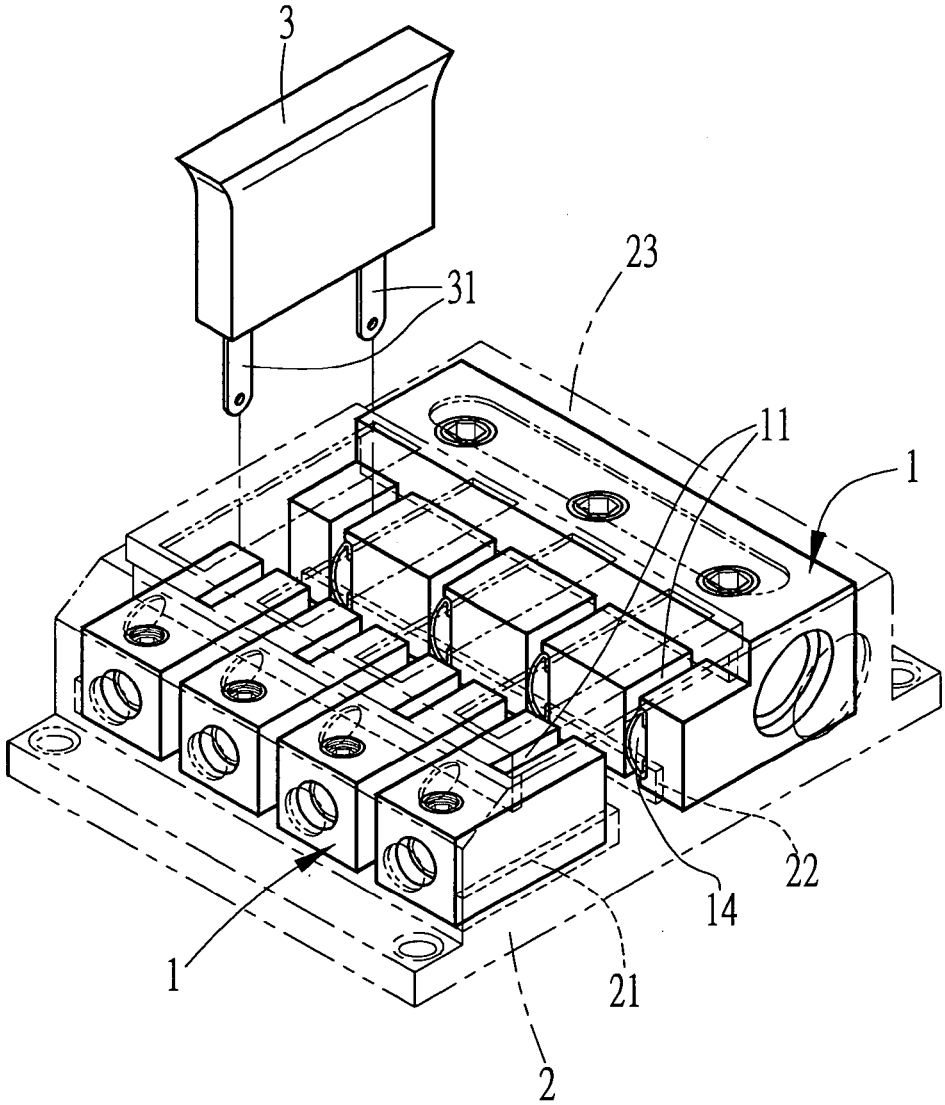
FIG. 5 is a perspective view of the fuse holder according to the present invention.
Figure 6:
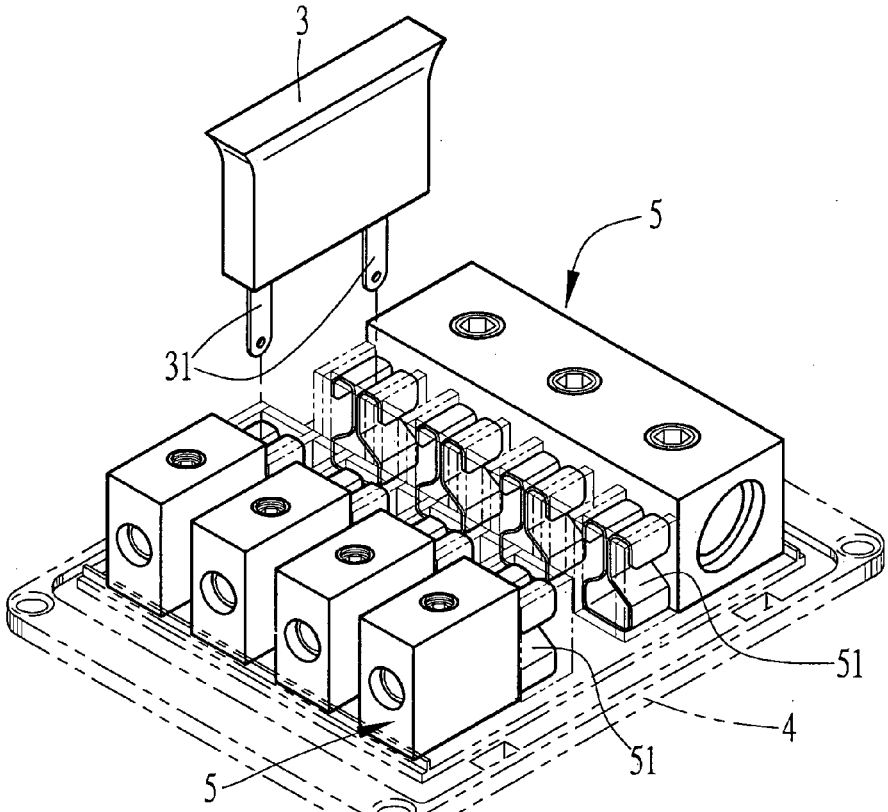
PRIOR ART Fig. 6
FIG. 6 is a perspective view of a fuse holder according to the prior art.
Figure 7:
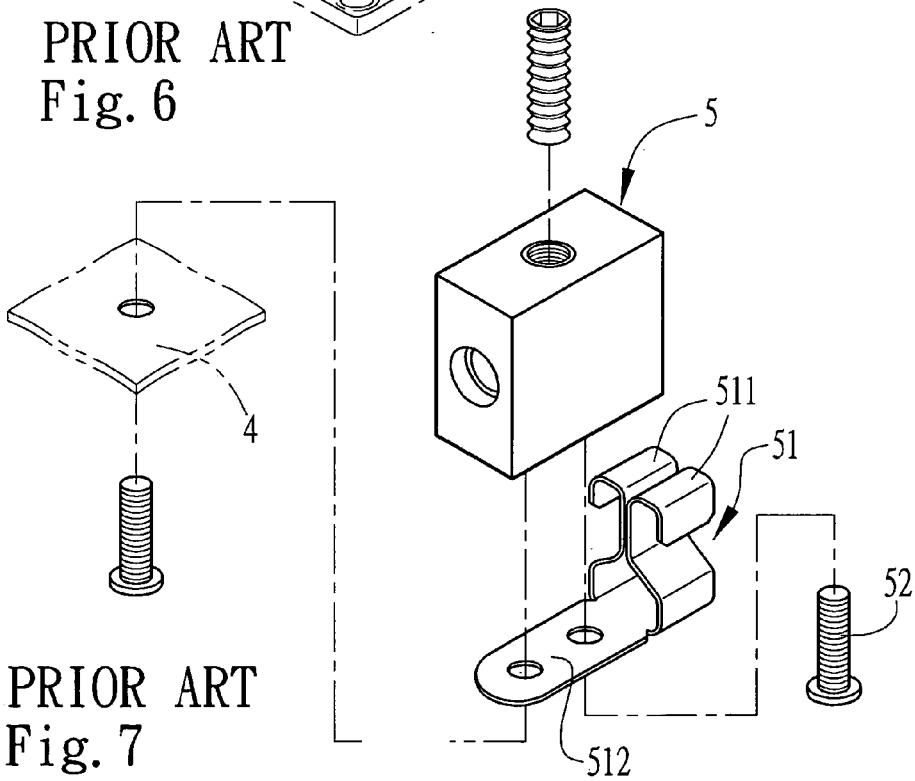
PRIOR ART Fig. 7
FIG. 7 is an exploded view in an enlarged scale of a part of the fuse holder shown in FIG. 6.
Figure 8:
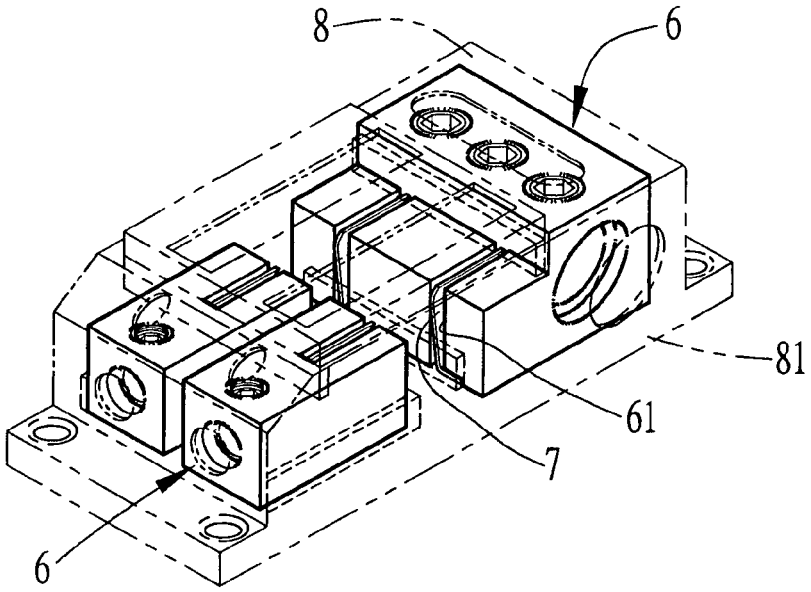
PRIOR ART Fig. 8
FIG. 8 is a perspective view of another design of fuse holder according to the prior art.
Figure 9:
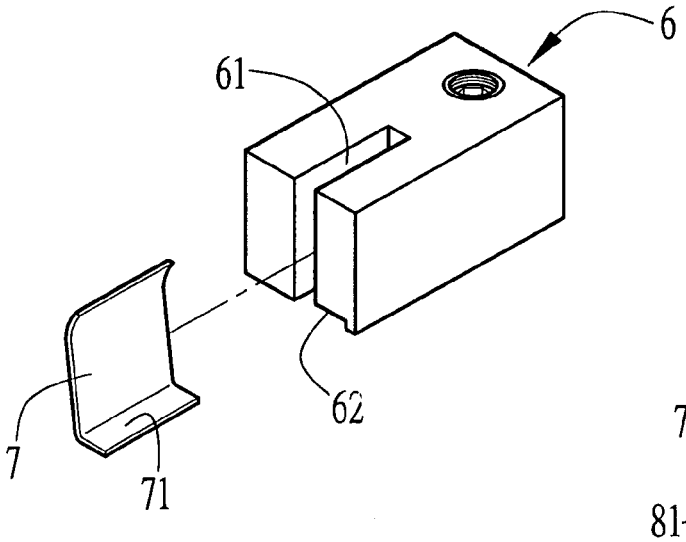
PRIOR ART Fig. 9
FIG. 9 is an exploded view in an enlarged scale of a part of the fuse holder shown in FIG. 8.
Figure 10:
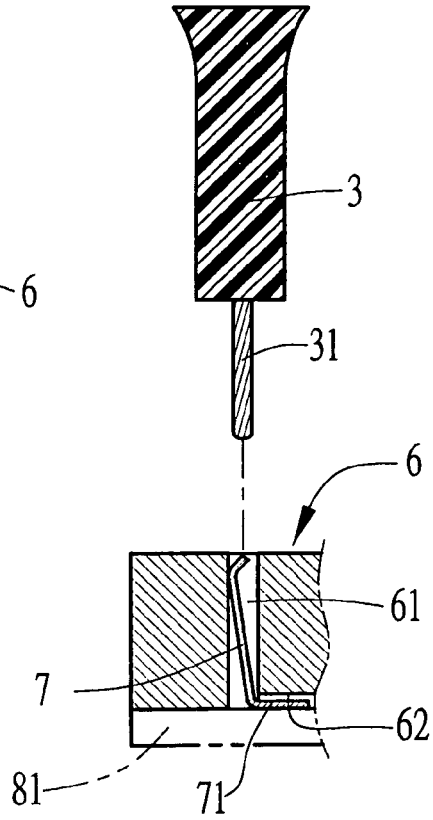
PRIOR ART Fig. 10
FIG. 10 is a sectional view in an enlarged scale of a part of the fuse holder shown in FIG. 8 showing the positioning status of the metal spring plate before insertion of a fuse.

Referring to FIGS. 1–5, a fuse holder is shown comprising a plurality of metal conducting blocks 1. Each metal conducting block 1 comprises at least one insertion slot 11 at one side and a recessed receiving hole 12 in each insertion slot 11 at one lateral side. A substantially arched metal spring plate 14 is mounted in the recessed receiving hole 12 in each insertion slot 11. The recessed receiving hole 12 has two stop edges 121 respectively disposed at the top and bottom sides. Each arched metal spring plate 14 has two positioning flanges 141 respectively extended from the two ends thereof. After insertion of one arched metal spring plate 14 in the recessed receiving hole 12 in each insertion slot 11, the two positioning flanges 141 are respectively stopped at the stop edges 121 in the recessed receiving hole 12, keeping the arched body curving outwards toward the opposite plain sidewall 13 of the insertion slot 11. When inserted the conducting blade 31 of one fuse 3 into the insertion slot 11, the conducting blade 31 is stopped between the arched body of the arched metal spring plate 14 and the opposite plain sidewall 13 of the insertion slot 11. Because the two positioning flanges 141 of the arched metal spring plate 14 are respectively stopped at the stop edges 121 in the recessed receiving hole 12, the arched metal spring plate 14 is forced to give a pressure to the conducting blade 31 of the fuse 3 against the are respectively stopped at the stop edges 121 in the recessed receiving hole 12, and therefore the fuse 3 is positively secured to the corresponding metal conducting block 1.

Further, the metal conducting blocks 1 are respectively mounted on a base 2. The base 2 comprises a plurality of fences 21;22 respectively stopped at the outer side of each insertion slot 11 of each metal conducting block 1 to prevent horizontal displacement of the arched metal spring plates 14 in the corresponding insertion slots 11 in the metal conducting blocks 1. After installation of the arched metal spring plates 14 in the metal conducting blocks 1 at the base 2, a top cover 23 is covered on the base 2 over the metal conducting blocks 1.

A prototype of fuse holder has been constructed with the features of FIGS. 1–5. The fuse holder functions smoothly to provide all of the features discussed earlier.

Although a particular embodiment of the invention has been described in detail for purposes of illustration, various modifications and enhancements may be made without departing from the spirit and scope of the invention. For example, the fans used can be cooling fans for use in hot weather, or fans with electric heater means for use in cold weather. Accordingly, the invention is not to be limited except as by the appended claims.

What the invention claimed is:

1. A fuse holder comprising:

a base;

a plurality of metal conducting blocks respectively mounted on a top side of said base for power input/output, said metal conducting blocks each comprising at least one insertion slot extending between a pair of spaced sidewalls, a recess being formed in one of said sidewalls of each said insertion slot to define a receiving hole portion;

a plurality of arched metal spring plates each mounted in the recessed receiving hole portion in said insertion slot to protrude bulbously from one said sidewall for holding down a conducting blade of a fuse in each said insertion slot; and a top cover fastened to said base and covered over said metal conducting blocks.

2. A fuse holder comprising:

a base;

a plurality of metal conducting blocks respectively mounted on a top side of said base for power input/output, said metal conducting blocks each comprising at least one insertion slot and a recess formed in each said insertion slot at one lateral side to define a receiving hole portion;

a plurality of arched metal spring plates respectively mounted in the recessed receiving hole portion in each said insertion slot and adapted to hold down the conducting blade of a fuse in each said insertion slot; and a top cover fastened to said base and covered over said metal conducting blocks;

wherein each said recessed receiving hole portion of each said metal conducting block has two vertically spaced stop edges; said arched metal spring plates each have two distal ends disposed in the recessed receiving hole portion in one said insertion slot at different elevations, and two positioning flanges respectively extended from said two distal ends and respectively stopped at the stop edges of the corresponding recessed receiving hole portion.

3. The fuse holder as claimed in claim 1, wherein said base comprises a plurality of fences respectively stopped at a front side of each said insertion slot of each said metal conducting block to hold said arched metal spring plates inside the insertion slots of said metal conducting blocks.

* * * * *